United States Patent [19]

Chen

[11] Patent Number: 4,863,083

[45] Date of Patent: Sep. 5, 1989

[54] SKIS AND BOOTS CARRYING WAIST BELT

[76] Inventor: Carl W. Chen, 1306 Ramsay Cir., Walnut Creek, Calif. 94596

[21] Appl. No.: 203,820

[22] Filed: Jun. 8, 1988

[51] Int. Cl.[4] ..... A45F 3/00; A45F 3/14

[52] U.S. Cl. ..... 224/226; 224/250; 224/917

[58] Field of Search ..... 224/250, 262, 901, 917, 224/222, 267, 103, 195, 208, 211, 215, 216, 224–228, 234, 253, 260, 184, 252, 269, 904, 914, 921; 294/147

[56] References Cited

U.S. PATENT DOCUMENTS

| | | | |
|---|---|---|---|
| 2,224,568 | 12/1940 | Altorfer | 224/917 |
| 2,428,074 | 9/1947 | Hanson | 224/250 |
| 2,613,953 | 10/1952 | Giovannoni | 224/184 |
| 3,096,010 | 7/1963 | Rasmussen | 224/921 |
| 4,420,104 | 12/1983 | DiIenno | 224/250 |
| 4,676,419 | 6/1987 | Victor | 224/901 |
| 4,751,923 | 6/1988 | Marino | 224/901 |

FOREIGN PATENT DOCUMENTS

| | | | |
|---|---|---|---|
| 2214104 | 3/1972 | Fed. Rep. of Germany | 224/917 |

*Primary Examiner*—Henry J. Recla
*Assistant Examiner*—J. Casimer Jacyna
*Attorney, Agent, or Firm*—Douglas E. White

[57] ABSTRACT

The invented device comprises a waist belt (20), two boot fasteners (24), and one ski fastener (30). The waist belt compreses a buckle (22) and a belt of adjustable length. The boot fastener is also a belt that can wrap around the calf support section of the boot and tie it up with self gripping fastener (28). The boot fastener is attached to the waist belt through a loop (26) or other comparable design. By a similar mechanism, the ski fastener can fasten a pair of skis in a vertical position from the waist to the front of the shoulder. The self gripping fastener is the preferred embodiment for fastening and unfastening the ski equipment.

7 Claims, 2 Drawing Sheets

SKIS AND BOOTS CARRYING WAIST BELT

FIELD OF INVENTION

This invention relates to a waist belt with fastening devices to carry skis and ski boots.

DISCUSSION OF PRIOR ART

Skiers often have to carry their skis, boots, poles and other items from a parking location to the ski slope. These many pieces of ski equipment are bulky to carry with bare hands.

A number of devices have been made to help carry the ski equipment. One boot carrier is commercially known the ski tote. The ski tote consists of a plastic plate molded onto a plastic foot. The ski boots are mounted on the opposite faces of the plastic plate, thus combining two boots into one object that can be carried by a single hand.

Another boot carrier, also commercially available, is made of a looped rope attached to a plastic rod of approximately 0.5 inch in diameter and 4 inches in length. Skiers use the rope to string a pair of boots together. The skiers hold the rod with one hand to carry the boots.

Ski carrying devices are also commercially available. One such device is a ski holding box, comprised to two rigid plates of approximately 18 inches long, 6 inches wide and 1 inch thick. The plates are hinged together along the long edge, allowing them to be swung open. The faces of the plates have grooves to fit the skis and poles. The skiers open the box, place the pairs of skis and poles into the grooves, close and lock the box which can then be carried by a single hand.

While these devices provide some convenience by consolidating several pieces of ski equipment into two objects for carrying, they have disadvantages. For example, the ski holding box carries the skis horizontally. Such a horizontal position can cause an accident and hurt other people in a crowded situation. Both hands of the skier are occupied carrying boots and skis, and are not free for any other action. Furthermore, it is tiring to carry all the equipment by hand. Skiers would therefore find it desirable to have a more convenient device to carry skis and boots.

OBJECTS AND ADVANTAGES

Accordingly, I claim the following as the objects and advantages of my invention: to provide a waist belt with fastening devices for boots and skis, in order to carry the skis in a vertical position from the waist to the front of the shoulder for safety and stability, to transfer the weight of ski equipment to the waist of a human body, and to free the hands of skiers to carry other objects.

Further objects and advantages of the invention can be appreciated by reviewing the ensuing description and the accompanying drawings.

DRAWING FIGURES

LIST OF REFERENCE NUMERALS

20 Waist Belt
22 Buckle
24 Boot Fastener
26 Loop of Boot Fastener
28 Self Gripping Fastener of Boot Fastener
30 Ski Fastener
32 Loop of Ski Fastener
34 Self Gripping Fastener of Ski Fastener

DESCRIPTION OF INVENTION

Figure 1:
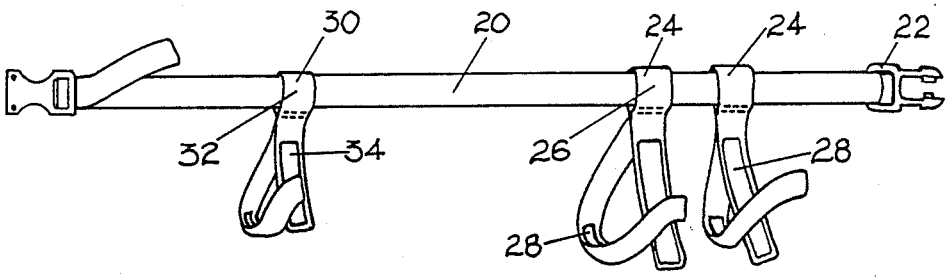
FIG. 1 shows the invented device, comprising a waist belt, two boot fasteners and one ski fastener.

FIG. 1 shows a ski and boot carrying waist belt according to the preferred embodiment of the invention. The invention is comprised of a waist belt (20) and a buckle (22). The length of the belt can be adjusted to fit individual skiers.

Figure 2:
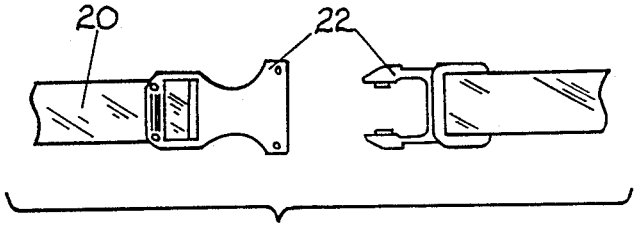
FIG. 2 shows the buckle of the device of FIG. 1.

The belt is preferrably made of nylon for strength. The buckle (22), as seen in FIG. 2, is preferrably made of molded plastic of recent design which is widely available and which has a simple buckling and un-buckling operation.

Figure 3:
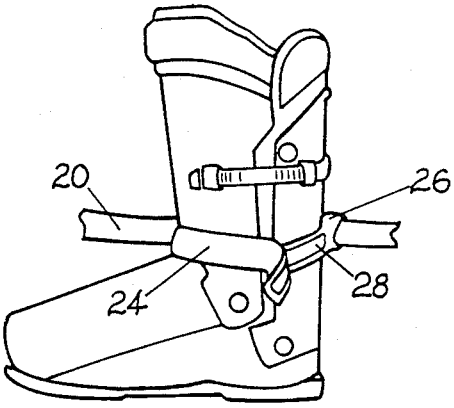
FIG. 3 shows the boot fastener of the device of FIG. 1.

FIG. 3 shows the fastening device for boots according to the preferred embodiment of the invention. The boot fastener (24) is preferrably made of nylon for consistency with the waist belt. It has a loop (26) which allows the waist belt (20) to go through. The fastening device is wrapped around the calf support section of a ski boot and secured using the self gripping fastener (28). Self gripping fasteners are widely available, for example, under the trademark VELCRO.

Figure 4:
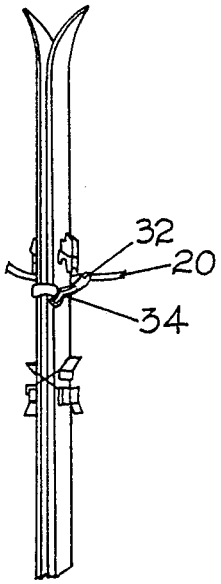
FIG. 4 shows the ski fastener of the device of FIG. 1.

FIG. 4 shows the fastening device for skis according to the preferred embodiment of the invention. The ski fastener (30) is preferrably made of nylon for consistency with the waist belt. The device also has a loop (32) which allows the waist belt (20) to go through. The fastening device is wrapped around a pair of skis and then secured using the self gripping fastener (34).

Figure 5:
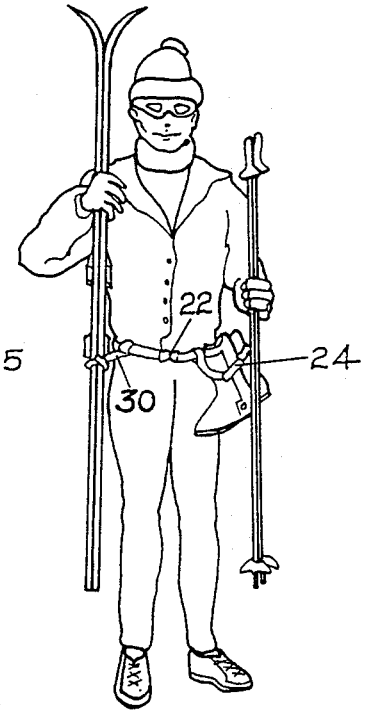
FIG. 5 shows a front view of a skier carrying boots and skis with the invented device of FIG. 1.

FIG. 5 shows a skier who carries a pair of skis and a pair of boots with the invented device.

OPERATION OF INVENTION

The invented device will come with one waist belt, two boot fasteners and one ski fastener. The boot fasteners and ski fastener will already be attached to the waist belt by passing the waist belt through the loop of each fastener.

To use the device, a skier will first adjust the waist belt to fit his or her waist. The skier will put on the waist belt and buckle it. The skier will slide the boot fastener to the front, fasten a boot, and then slide the boot to the left hand side of his or her waist. This operation is performed for both boots, one at a time.

The skier will then slide the ski fastener to the right hand side of his or her waist. The skier will first put the pair of skis facing each other and press them to let ski brakes hold the pair together. The skier will hold the skis in an upright position and in front of his or her shoulder. The skier will use the ski fastening device to wrap around the skis below the front end of ski bindings and fasten them by the self gripping fastener.

SCOPE OF INVENTION

While the above description contains many specific details, the reader should not construe these as limitations on the scope of the invention, but merely as exemplification of preferred embodiments thereof. Skilled artisans can make many variations within the scope of the invention. Instead of belts made of nylon, other materials, such as fabric and leather, can be used. They can use fastening mechanisms other than the self gripping fastener. They can use hooks or other connecting devices to attach the ski and boot fasteners to the waist belt. Accordingly, the reader is requested to evaluate the scope of the invention by the appended claims and their legal equivalents, and not by the examples which have been given.

CONCLUSION

Users will find the invention advantageous because it ties every major piece of ski equipment to the waist belt except the poles. Each attached equipment is stable by itself. Hands are free to carry other items. The skis, which are in a vertical position, will not swing to hurt other people in a crowded situation. The right hand of the user can carry the ski poles and lean on the skis to increase stability during the walk.

Upon arrival at the destination, all equipment can be un-fastened by a simple operation of peeling open the self gripping fastener. The waist belt and various fasteners can be taken off and placed in a locker. Or, the skiers can wear them and hide them under the ski jacket.

Other than the buckle, all parts of the invention are made of soft materials and are safe in case the skier falls.

I claim:

1. An apparatus for carrying skis and ski boots including:

a waist belt means adapted to be secured about the waist of a user and having two waist belt ends, buckle means on said waist belt means for securing the waist belt ends together and for adjusting the length of the waist belt means;

at least one boot fastener belt means adapted to be secured around a ski boot and having only two boot fastener belt ends, self gripping means in said boot fastener belt means for securing the boot fastener belt ends together and for adjusting the length of the boot fastener belt means;

means for attaching the boot fastener belt means to the waist belt means, said boot fastener belt means attaching means being engaged with the waist belt means but free to slide throughout the length of the waist belt means;

at least one ski fastener belt means adapted to be secured around skis and having only two ski fastener belt ends for holding skis in a vertical orientation, self gripping means in said ski fastener belt means for securing the ski fastener belt ends together and for adjusting the length of the ski fastener belt means;

means for attaching the ski fastener belt means to the waist belt means, said ski fastener belt means attaching means being engaged with the waist belt means but free to slide throughout the length of the waist belt means.

2. The apparatus of claim 1 wherein:

said boot fastener belt means attaching means is a first closed loop formed in the boot fastener belt means, the waist belt means slideably passing through the first closed loop.

3. The apparatus of claim 2 wherein:

there are two boot fastener belt means.

4. The apparatus of claim 3 wherein:

the ski fastener belt means attaching means is a second closed loop formed in the ski fastener belt means, the waist belt means slideably passing through the second closed loop.

5. The apparatus of claim 4 wherein:

there is one ski fastener belt means.

6. The apparatus of claim 5 wherein:

said belt means are made of nylon.

7. An apparatus for carrying skis and ski boots including:

a nylon waist belt means adapted to be secured about the waist of a user and having two waist belt ends, molded plastic buckle means for securing the waist belt ends together and for adjusting the length of the waist belt means;

two nylon boot fastener belt means adapted to be secured around a ski boot and having, each with only two boot fastener belt ends, self gripping means in said boot fastener belt means for securing their respective boot fastener belt ends together and for adjusting the length of the boot fastener belt means;

two first closed loops, one formed in each boot fastener belt means, the waist belt means slideably passing through the first closed loops, whereby the boot fastener belt means are engaged with the waist belt means but free to slide throughout the length of the waist belt means;

one nylon ski fastener belt means adapted to be secured around skis and having only two ski fastener belt ends for holding skis in a vertical orientation, self gripping means in said ski fastener belt means for securing the ski fastener belt ends together and for adjusting the length of the ski fastener belt means;

one second closed loop formed in the ski fastener belt means, the waist belt means slideably passing through the second closed loop, whereby the ski fastener belt means is engaged with the waist belt means but free to slide throughout the length of the waist belt means.

* * * * *